United States Patent [19]

Kennedy et al.

[11] Patent Number: 4,846,959

[45] Date of Patent: Jul. 11, 1989

[54] MANUFACTURE OF PREMIUM FUELS

[75] Inventors: Clinton R. Kennedy, Talleyville, Del.; Stuart S. Shih, Cherry Hill, N.J.

[73] Assignee: Mobil Oil Corporation, New York, N.Y.

[21] Appl. No.: 86,742

[22] Filed: Aug. 18, 1987

[51] Int. Cl.[4] ..... C10G 65/00; C10G 65/12

[52] U.S. Cl. ..... 208/97; 208/15; 208/17; 208/28; 208/78; 208/89; 208/111; 208/208 R; 585/1; 585/14; 585/739

[58] Field of Search ..... 208/78, 97, 111, 208 R, 208/15, 28, 89, 17, 19; 585/739, 1, 14

[56] References Cited

U.S. PATENT DOCUMENTS

| | | | |
|---|---|---|---|
| 3,522,169 | 7/1970 | Ireland | 208/15 |
| 3,668,113 | 6/1972 | Burbidge et al. | 208/97 |
| 3,861,005 | 1/1975 | Steinmetz et al. | 585/739 |
| 3,894,937 | 7/1975 | Bonacci et al. | 208/97 |
| 3,894,938 | 7/1975 | Gorring et al. | 208/97 |
| 4,176,050 | 11/1979 | Chen et al. | 502/74 |
| 4,181,598 | 11/1980 | Gillespie et al. | 208/58 |
| 4,222,855 | 9/1980 | Pelrine et al. | 208/111 |
| 4,229,282 | 10/1980 | Peters et al. | 208/111 |
| 4,247,388 | 1/1981 | Banta et al. | 208/111 |
| 4,259,174 | 3/1981 | Chen et al. | 208/111 |
| 4,269,695 | 5/1981 | Silk et al. | 585/739 |
| 4,419,220 | 12/1983 | La Pierre et al. | 208/111 |
| 4,428,819 | 1/1984 | Shu et al. | 208/111 |
| 4,436,614 | 3/1984 | Orbrich et al. | 208/111 |
| 4,501,926 | 2/1985 | La Pierre et al. | 208/111 |
| 4,568,655 | 2/1986 | Oleck et al. | 208/111 |
| 4,605,488 | 8/1986 | Chesler et al. | 208/111 |
| 4,673,718 | 2/1978 | Hamner | 208/111 |

*Primary Examiner*—H. M. S. Sneed
*Assistant Examiner*—Helane Myers
*Attorney, Agent, or Firm*—Alexander J. McKillop; Charles J. Speciale; Malcolm D. Keen

[57] ABSTRACT

A process is provided wherein premium fuels are manufactured from a high sulfur, low pour point feed and a low sulfur, high pour point feed. The feeds are treated individually (blocked operation) in a catalytic reactor that desulfurizes or dewaxes the feed, depending on temperature, and the effluents are combined. Since cut point limitations due to sulfur or pour point are removed by the process, yield of a fuel (e.g. jet fuel) is materially enhanced.

18 Claims, No Drawings

MANUFACTURE OF PREMIUM FUELS

FIELD OF THE INVENTION

This invention is concerned with a process for the manufacture of a premium fuel such as jet fuel from conventional and unconventional feeds. The capability of the process for upgrading an unconventional feed results in production of substantial incremental quantities of the premium fuel.

BACKGROUND OF THE INVENTION

The production limit for a particular fuel in petroleum refineries is controlled by factors such as crude capacity, individual process capacities, availability of particular crudes and total petroleum product demand. These factors interact in a complex physical and economic way such that at a particular point in time a refiner may be unable to supply the demand for a particular premium fuel, such as jet fuel meeting Jet-A specifications, from a straight-run kerosene fraction. The term "premium fuels" as used herein refers broadly to distillate fuels boiling within the range of 250° F. to 700° F., and more specifically to jet fuel, kerosene, naphtha, diesel fuel and heating oils.

Conventional catalytic hydrodesulfurization (CHD) is a well known process for reducing the sulfur content of a virgin kerosene of otherwise suitable quality to bring such a feed into conformance with the sulfur specification for jet fuel. Typical CHD catalysts contain from about 2 to about 4 wt % cobalt and about 8 to about 10.5 wt % molybdenum on an alumina support. The CHD process with a kerosene feed typically is operated at 450° F. to 750° F., at a hydrogen partial pressure of 200 to 800 psia, at a liquid hourly space velocity of 0.5 to 5.0, and with 400 to 3000 standard cubic feet per barrel (SCF/Bbl) of hydrogen circulation to effect 60% to 90% desulfurization. There are a number of commercially available catalyts which differ in the nature of the support, amount of metal, etc., and also a number of known process variations. The CHD process per se is not considered a part of this invention. The described use of the commonplace CHD process to upgrade a high sulfur virgin kerosene feedstock to jet fuel specifications is representative of the use of a "conventional" feedstock for a premium distillate fuel.

Conventional hydrocracker (HDC) recycle has a sulfur content well within the specification for jet quality fuel, but an unacceptably high freeze point. Although very small amounts of HDC recycle might be blended with CHD treated virgin kerosene to augment the supply of jet fuel, this would furnish only a very small incremental supply of this premium fuel.

Processes for dewaxing petroleum distillates have been known for a long time. Dewaxing, as is well known, is required when highly paraffinic oils are to be used in products which need to remain mobile at low temperatures. The higher molecular weight straight chain normal and slightly branched paraffins which are present in oils of this kind are waxes which are the cause of high pour points in the oils and if adequately low pour points are to be obtained, these waxes must be wholly or partly removed. Catalytic dewaxing processes achieve this objective by selectively cracking the longer chain n-paraffins to produce lower molecular weight products which may be removed by distillation. Processes of this kind are described, for example, in The Oil and Gas Journal, Jan. 6, 1975, pages 69 to 73 and U.S. Pat. No. 3,668,113, incorporated herein by reference for background purposes.

In order to obtain the desired selectivity in catalytic dewaxing, the catalyst has usually comprised an acidic zeolite having a pore size which admits only the straight chain n-paraffins, or these along with only slightly branched chain paraffins, but which excludes more highly branched materials, cycloaliphatics and aromatics. Zeolites such as ZSM-5, ZSM-11, ZSM-12, ZSM-23, ZSM-35 and ZSM-38 have been proposed for this purpose in dewaxing processes and their use is described in U.S. Pat. Nos. 3,894,938; 4,176,050; 4,181,598; 4,222,855; 4,229,282 and 4,247,388. A dewaxing process employing synthetic offretite is described in U.S. Pat. No. 4,259,174. The content of these patents are incorporated by reference for background purposes.

Since the dewaxing processes just described function by means of cracking reactions, a number of useful products become degraded to lower molecular weight materials. For example, distillate and naphtha range materials may be cracked to butane, propane, ethane and methane, and so may the lighter n-paraffins which do not contribute to the waxy nature of the oil. These lighter products are generally of lower value than higher molecular weight materials.

U.S. 4,419,220 to La Pierre et al. discloses that distillate feedstocks may be effectively dewaxed by isomerizing the waxy paraffins without substantial cracking. The isomerization is effected with a Zeolite Beta catalyst and may be conducted either in the presence or absence of added hydrogen. The catalyst should include a hydrogenation component such as platinum or palladium in order to promote the reactions which occur. The hydrogenation component may be used to promote certain hydrogenation/dehydrogentation reactions which will take place during the isomerization. The process described in U.S. Pat. No. 4,419,220 is carried out at elevated temperature and pressure. Temperatures will normally be from 250° C. to 500° C. (about 480° F. to 930° F.) and pressures from atmospheric up to 25,000 kPa (3,600 psig). Space velocities will normally be from 0.1 to 20. The entire content of U.S. Pat. No. 4,419,220 is herein incorporated by reference as if fully set forth.

The foregoing hydrodewaxing process may be used to dewax a variety of feedstocks ranging from relatively light distillate fractions up to high boiling stocks, including waxy distillate stocks such as gas oils, kerosenes, jet fuels, lubricating oil stocks, heating oils and other distillate fractions whose pour point and viscosity need to be maintained within certain specification limits. Hydrocracked stocks are a convenient source of stocks of this kind and also of other distillate fractions since they normally contain significant amounts of waxy n-paraffins which have been concentrated by the hydrocracking of naphthenes and aromatics. The feedstock will normally be about a $C_{10}+$ feedstock containing paraffins, olefins, naphthenes, aromatics and heterocyclic compounds and with a substantial proportion of higher molecular weight n-paraffins and slightly branched paraffins which contribute to the waxy nature of the feedstock. During the processing, the n-paraffins become isomerized to iso-paraffins and the slightly branched paraffins undergo isomerization to more highly branched aliphatics. At the same time, a measure of cracking does take place so that not only is the pour point reduced by reason of the isomerization of nparaffins to the less waxy branched chain iso-paraffins but, in addition, the heavy ends undergo some cracking or hydrocracking to form liquid range materials which contribute to a low viscosity product. The degree of cracking which occurs is, however, limited so that the gas yield is reduced, thereby preserving the economic value of the feedstock.

It is an object of this invention to provide a hydrodesulfurization-hydrodewaxing process for the manufacture of premium distillate fuels from two different feeds, one of which requires hydrodesulfurization and the other of which requires dewaxing. It is a further object of this invention to provide such a process utilizing a single reactor containing a hydrodesulfurization catalyst and a hydrodewaxing catalyst. It is a still further object to provide a process for manufacturing jet quality fuel from kerosene and hydrocracker recycle by passing each feed in blocked oleration and hydrogen gas over an HDS catalyst and a dewaxing catalyst, in that order, and blending the effluents from the two blocked feeds. These and further objects will become evident from reading this entire specification including the appended claims.

SUMMARY OF THE INVENTION

In one embodiment, this invention provides a process for manufacturing a premium distillate fuel boiling within the range of 250° F. to 700° F. from two different feeds, the first of said feeds requiring desulfurization and the second feed requiring dewaxing, which process comprises:

(a) providing as first feed a hydrocarbon fraction within the desired boiling range and which contains an unacceptably high sulfur content;

(b) providing as second feed a hydrocarbon fraction with an unacceptably high wax content and high end point;

(c) providing a catalytic reactor containing a bed of hydrodewaxing catalyst comprising Zeolite Beta associated with a hydrogenation metal and a bed of hydrodesulfurization catalyst, said beds having a volumetric ratio of 80:20 to 20:80, with said bed of hydrodesulfurization catalyst being located downstream of said hydrodewaxing catalyst;

(d) passing through said catalytic reactor sequentially and in either order said first feed and hydrogen under hydrodesulfurization conditions and said second feed and hydrogen under hydrodewaxing conditions whereby forming hydrodesulfurized effluent from said first feed and hydrodewaxed effluent from said second feed; and, (e) combining said hydrodesulfurized effluent and said hydrodewaxed effluent formed in step (d), all as more fully described hereinbelow.

A preferred embodiment of this invention utilizes a dewaxing catalyst comprising Zeolite Beta associated with platinum, which strongly favors hydroisomerization of the waxes to low-melting products thereby reducing conversion to low-valued light products, and which also favors moderate reduction of the 90% point or end point of the feed, thereby permitting use of a wider boiling fraction as feed. In a particularly preferred embodiment of this invention, jet fuel is manufactured by providing a high sulfur virgin kerosene as first feed and a wide-range hydrocracker cut HDC recycle as second feed, all as more fully described hereinbelow.

DETAILED DESCRIPTION AND BEST MODE

The concept of this invention contemplates use of two different feeds to enable a refinery to produce substantial incremental amounts of quality jet fuel, kerosene, naphtha, diesel fuel or a heating oil.

The first feed to the process of this invention is provided by a straight-run distillation cut which, except for excessive sulfur content, is within boiling range and other specifications for a particular selected product. This first feed must be an enable to being brought into specification for sulfur content, and without loss of product quality, by conventional CHD processing.

The second feed to the process of this invention is provided by any hydrocarbon fraction that meets or only slightly exceeds the sulfur content specification for the same selected product as designated for the first feed, but that has deficient flow properties at low temperature due to excessive wax content. Deficient low temperature flow properties may be evidenced by an unacceptable cloud point, freeze point, pour point or other measure correlated with wax content. The second feed, in general, should be in conformance with other property specifications for the designated product. However, as will be more fully illustrated by example hereinbelow, the end point (or 90% cut point) of the fraction prior to processing by the method of this invention may somewhat exceed specification and still produce a treated product within specification, which is an advantage of this invention. Similarly, a modest excess in aromatics content is usually brought into specification by the process of this invention. In general, however, aside from noncomformance in low temperature properties, the second feed to the process of this invention conforms or almost conforms to other specifications for the designated product. As is recognized by one skilled in the art, different fuels have become associated with different specifications. The above remarks on aromatic content, for example, are pertinent only for jet fuels. Other specifications, such as Diesel Index or Cetane Nuxber, are relevant for diesel fuels and have no bearing on jet fuels.

The process of this invention requires two catalytic zones that contain different catalysts. The first zone, located upstream of the second zone, contains the hydrodewaxing catalyst and the second, downstream zone the hydrodesulfurization catalyst.

The especially preferred hydrodewaxing catalyst for the process of this invention contains as active acidic component Zeolite Beta and a strong hydrogenation/-dehydrogenation component such as platinum or palladium. Zeolite Beta is a known zeolite and is described in U.S. Pat. No. Re. 28,341, incorporated herein by reference for a description of the zeolite, its preparation and properties. As is known, dewaxing with Zeolite Beta is effected largely by isomerization of waxes to non-waxy paraffins, thereby conserving feed volume. It is a particular advantage of the present process that the isomerization proceeds readily, even in the presence of significant proportions of arobatics in the feedstock and for this reason, feedstocks containing aromatics e.g. 10 percent or more aromatics, may be successfully dewaxed. The aroxatic content of the feedstock will depend, of course, upon the nature of the crude employed and upon any preceding processing steps such as hydrocracking which may have acted to alter the original proportion of aromatics in the oil. The aromatic content will normally not exceed 50 percent by weight of the feedstock and more ususally will be not more than 20 to 40 percent by weight, with the remainder consisting of paraffins, olefins, naphthenes and heterocyclics. The paraffins content (normal and iso-paraffins) will generally be at least 10 percent by weight, more usually at least 20 to 50 percent by weight.

The preferred forms of Zeolite Beta for use as hydrodewaxing catalyst in the present process are the high silica forms, having a silica to alumina ratio of at least 30:1 (structural). Silica to alumina ratios of at least 50:1 and even at least 100:1 may be used in order to maximize dewaxing by paraffin isomerization reactions at the expense of cracking. Methods for making highly siliceous forms of Zeolite Beta are described in EU No. 95,304 to which reference is made for a description of them. The silica to alumina ratios referred to in this specification are the structural or framework ratios as mentioned in EU No. 95,304.

For use as catalyst, Zeolite Beta is usually composited with a binder such as alumina and is extruded to form pellets 1/16" or ⅛" in diameter. The platinum may be deposited on the catalyst before or after pellet formation by impregnation or by ion exchange, as known to those skilled in the art. A satisfactory catalyst for purposes of the present invention comprises about 65 parts by weight of Zeolite Beta in the hydrogen form having a silica to alumina ratio of about 40:1, 35 parts by weight of alumina binder, and about 0.5 wt % (based on total catalyst) of platinum.

It is contemplated to use a conventional cobalt-moly hydrodesulfurization catalyst as the hydrodesulfurization catalyst in the second catalytic zone.

It is particularly preferred for purposes of the present invention to provide the two catalytic zones in a single reactor. Such a configuration is simple and entails low capital and maintenance costs.

The process of this invention is operated in what is commonly known as a blocked-feed mode. Specifically, both the first feed and the second feed are processed alone, and the separate effluents, which may be accumulated in one or more storage vessels, are blended. As will be illustrated herein by example, preblending of the feeds unexpectedly leads to loss of product quality.

In the present invention, it is preferred to treat both feeds under the same process condition except for temperature. These conditions are as follows:

| | Pressure, psig | LHSV, $hr^{-1}$ | $H_2$ Circ. $ft^3$/Bbl |
|---|---|---|---|
| Broad | 200–1500 | 0.2–10.0 | 500–4000 |
| Preferred | 400–1000 | 0.5–5.0 | 1000–3000 |
| Most Preferred | 400–700 | 1.0–4.0 | 1000–2000 |

Process temperatures for the first and second feeds are as follows:

| | Temp., °F. | |
|---|---|---|
| | First Feed | Second Feed |
| Broad | 400–800 | 400–850 |
| Preferred | 500–750 | 500–750 |
| Most Preferred | 500–650 | 550–700 |

The simple process herein described makes it possible for a fuels refiner to provide substantial incremental quantities of a premium fuel as needed under circumstances which prevail at a particular time. The process is attractive because of its simplicity and its flexibility. Flexibility is realized because the particular dual bed configuration used in the process, while accepting unconventional feeds when available and needed, preserves the ability to desulfurize conventional feeds should circumstances indicate this as a preferred operation.

Specific examples of this invention follow. The examples are given for illustrative purposes only, and are not to be construed as limiting the scope of the invention, which scope is determined by this entire specification including the appended claims.

EXAMPLES 1–4

Two individual feeds and a 50:50 blend of the two were processed in the four examples described below. One feed was a virgin kerosene which has boiling point distribution between about 350° F. and 520° F., well below the 572° F. end point specification for Jet-A fuel. Its sulfur content of 2900 ppm, however, is well above the 1000 ppm specification for Jet A. The other feed is an HDC recycle very low in sulfur content, but high in freeze point and with a high end point. The HDC recycle cannot be used as Jet A fuel without further upgrading. The properties of the two individual feeds, and of the 50:50 mixture of the two feeds, are shown in Table I along with relevant specifications for Jet A fuel.

Experiments were conducted in a fixed-bed, downflow, single reactor pilot unit. The isomerization catalyst was loaded in the top, and desulfurization catalyst in the bottom of reactor. Prior to the experiments, both catalysts were simultaneously presulfided in-situ with a 2% $H_2S$ in H2 at a final temperature of 700° F. Data were taken after the catalyst system had equilibrated with the feedstock for each example. The unit was operated at constant conditions (625 psig $H_2$, 2.4 LHSV based on total catalyst volume, and 1400 SCF/B $H_2$), except for reactor temperature which was adjusted to achieve desired performance. Properties of the hydrodesulfurization and hydroisomerization catalysts are given in Table II.

TABLE I

| FEEDSTOCK PROPERTIES | | | | |
|---|---|---|---|---|
| Identification | Kerosene | HDC Recycle | Kero/HDC Recycle 50/50 Mix | Jet-A Spec. |
| ANALYSES | | | | |
| Gravity, °API | 40.2 | 42.5 | 41.5 | 37–51 |
| Hydrogen, wt % | 13.80 | 13.98 | 13.84 | — |
| Sulfur, ppm | 2900 | 10 | 1500 | <1000 |
| Freeze Pt., °F. | −45 | 10 | −8 | <−40 |
| Smoke Pt., mm | 20.0 | 19.5 | 19.5 | >18 |
| Diesel Index | 54.7 | 60.1 | 57.1 | — |
| KV @ 40° C., cs | 1.598 | 1.376 | 1.539 | — |
| FIA, Vol. % | | | | |
| Saturates | 74.3 | 72.6 | 73.5 | — |
| Olefins | 3.1 | 3.0 | 3.0 | — |
| Aromatics | 22.6 | 24.4 | 23.5 | <25 |
| DISTILLATION, °F. ASTM D-86 | | | | |
| IBP | 351 | 235 | 280 | |
| 5% | 384 | 273 | 325 | |
| 10% | 392 | 289 | 340 | <400 |
| 30% | 411 | 349 | 415 | |
| 50% | 428 | 423 | 426 | |
| 70% | 449 | 494 | 472 | |
| 90% | 477 | 567 | 521 | |
| 95% | 489 | 602 | 546 | |
| EP | 516 | 635 | 580 | <572 |

TABLE II

| FRESH CATALYST PROPERTIES | Dewaxing Catalyst | HDS Catalyst |
|---|---|---|
| Extrudate Size, Inches | 1/16 | ⅛ |
| METALS, WT. % | | |
| Platinum | 0.56 | — |
| Cobalt | — | 2.4 |
| Molybdenum | — | 9.8 |
| DENSITY, g/cc | | |
| Packed | 0.53 | 0.56 |
| Particle | 0.88 | 0.99 |
| Real | 2.57 | 3.54 |
| PHYSICAL PROPERTIES | | |
| Pore Volume, cc/g | 0.75 | 0.73 |
| Surface Area, $m^2/g$ | 369 | 283 |
| Avg. Pore Dia., A.U. | 81 | 103 |

EXAMPLE 1

In this example, the kerosene feed alone was passed through the reactor. At a LHSV of 9.6 based on the volume of the CHD catalyst and at 534° F., the system reduced the sulfur content from 0.29 wt % to 0.1 wt % with preservation of virgin kerosene quality suitable for Jet-A fuel blending. The results are shown in Table III.

EXAMPLE 2

In this example, the catalyst system at a LHSV of 3.2 based on the volume of the Zeolite Beta hydroisomerization catalyst and at 640° F. upgraded HDC recycle to Jet-A fuels by simultaneously reducing freezing point (−45° F.) and lowering the end-point temperature (570° F.). Furthermore, the upgraded 250° F.+ quality is also further improved; aromatics content was lowered (25.5 to 15.5 vol %) and diesel index was increased (60.1 to 62.6). These results also are shown in Table III.

EXAMPLES 3–4

In Example 3, a 50:50 blend of the kerosene and HDC recycle was passed through the reactor at 646° F. In Example 4, the same blend was fed but at 673° F.

With the blended feed, the required temperature to meet a freeze point specification at −40° F. was higher than that when HDC recycle alone was processed. The upgraded 250° F.+ distillate of Example 3 unexpectedly had a smoke point of 15.5 mm, not suitable for Jet-A fuel blending, and its end-cut point was too high (580° F.). Operation at higher temperature (673° F., Example 4) lowered the end-point temperature (560° F.) but it did not improve smoke point (15.5 mm), and aromatics content was marginal (25.7 vol %). The results of Examples 3 and 4 are included in Table III.

TABLE III

| PILOT RUNS | EXAMPLE NO. | | | | |
|---|---|---|---|---|---|
| EXAMPLE NO. | 1 | 2 | 3 | 4 | Jet-A |
| FEEDSTOCK | Kerosene | HDC Recycle | 50/50 Mix | | Spec. |
| OPERATING CONDITIONS | | | | | |
| Pressure, psig | 625 | 625 | 625 | 625 | |
| Temp., °F. | 534 | 640 | 646 | 673 | |
| LHSV, Hr-1 | 2.4 | 2.4 | 2.4 | 2.4 | |
| $H_2$ Cons., SCF/Bbl | 129 | 382 | 166 | 200 | |
| 250° F. + ANALYSES | | | | | |
| Freeze Pt., °F. | −47 | −45 | −38 | −65 | <−40 |
| Gravity, °API | 40.4 | 46.5 | 42.2 | 41.3 | 37–51 |
| Sulfur, ppm | 920 | 10 | 25 | 9 | <1000 |
| Smoke Pt., mm | 19.5 | 18.5 | 15.5 | 15.5 | >18 |
| Diesel Index | 56.0 | 62.6 | 55.9 | 51.2 | — |
| Aromatics, vol. % | 22.1 | 15.5 | 22.7 | 25.7 | <25 |
| DISTILLATION, °F. | | | | | |
| 10% | 392 | 262 | 312 | 310 | <400 |
| 30% | 410 | 302 | 363 | 350 | |
| 50% | 428 | 350 | 406 | 391 | |
| 70% | 448 | 418 | 444 | 431 | |
| 90% | 477 | 518 | 507 | 491 | |
| EP | 511 | 570 | 580 | 561 | <572 |

What is claimed is:

1. A process for manufacturing a premium distillate fuel or blending stock therefor boiling within the range of 250° F. to 700° F. from two different feeds, the first of said feeds requiring desulfurization and the second feed requiring dewaxing, which process comprise:
   (a) providing as first feed a hydrocarbon fraction within the desired boiling range and which contains a sulfur content which exceeds the specification for said premium fuel;
   (b) providing as second feed by a hydrocarbon fraction with a pour point and distillation end-point that are higher than specification for said premium fuel;
   (c) providing a catalytic reactor containing a bed of hydrodewaxing catalyst comprising Zeolite Beta associated with a hydrogenation metal and a bed of hydrodesulfurization catalyst, said beds having a volumetric ratio of 80:20 to 20:80, with said bed of hydrodesulfurization catalyst being located downstream of said hydrodewaxing catalyst;
   (d) passing through both beds of said catalytic reactor sequentially and in either order said first feed and hydrogen under hydrodesulfurization conditions and said second feed and hydrogen under hydrodewaxing conditions whereby forming hydrodesulfurized effluent from said first feed and hydrodewaxed effluent from said second feed, and
   (e) recovering premium distillate fuel product formed in step (d).

2. The process described in claim 1 wherein said first feed is a virgin distillate having a sulfur content greater than 0.2 wt % and said second feed has a pour point greater than about 10° F.

3. The process described in claim 1 wherein said hydrogenation metal is platinum.

4. The process described in claim 2 wherein said hydrogenation metal is platinum.

5. The process described in claim 2 wherein said premium distillate fuel is jet fuel, said first feed is a virgin kerosene and said second feed is hydrocracker recycle having an end point not greater than about 650° F.

6. The process described in claim 4 wherein said premium distillate fuel is jet fuel, said first feed is a virgin kerosene and said second feed is hydrocracker recycle having an end point not greater than about 650° F.

7. The process described in claim 2 wherein said first feed is a virgin distillate in the diesel fuel boiling range and said second feed is hydrocracker recycle having an end point below 1000° F.

8. The process described in claim 4 wherein said first feed is a virgin distillate in the diesel fuel boiling range and said second feed is hydrocracker recycle having an end point below 1000° F.

9. A process for manufacturing a jet fuel or blending stock therefor from a virgin kerosene having a sulfur content of about 0.2 to 2.0 wt % and a hydrocracker recycle having a pour point greater than about 10° F., which process requires:

(a) distilling said virgin kerosene to recover a fraction within the boiling range and below the freeze-point limit for said jet fuel but with a sulfur content which exceeds the jet fuel specification;

(b) distilling said hydrocracker recycle to recover a fraction having a sulfur content at or below that required for said jet fuel but having a freeze point which exceeds the jet fuel specification;

(c) providing a catalytic reactor containing a bed of hydrodewaxing catalyst comprising Zeolite Beta associated with a hydrogenation metal and a bed of hydrodesulfurization catalyst, said beds having a volumetric ratio of 80:20 to 20:80, with said bed of hydrodesulfurization catalysts being located downstream of said hydrodewaxing catalyst;

(d) passing through both beds of said catalytic reactor sequentially and in either order said recovered fraction of virgin kerosene and hydrogen under hydrodesulfurization conditions and said recovered fraction of hydrocracker recycle and hydrogen under hydrodewaxing conditions whereby forming hydrodesulfurized effluent from said first feed and hydrodewaxed effluent from said second feed; and, (e) recovering jet fuel product formed in step (d).

10. The process described in claim 9 wherein said hydrodesulfurization and hydrodewaxing conditions include a pressure of 200–1500 psig, 0.2–10 LHSV, a hydrogen recirculation of about 500–4000 ft3/Bbl, and wherein said hydrodesulfurization temperature is 400° F.–800° F. and said hydrodewaxing temperature is 400° F.–850° F.

11. The process described in claim 9 wherein said hydrogenation metal is platinum and said Zeolite Beta has a silica to alumina ratio of at least about 50:1.

12. The process described in claim 10 wherein said hydrogenation metal is platinum and said Zeolite Beta has a silica to alumina ratio of at least about 50:1.

13. The process described in claim 9 wherein said recovered hydrocracker recycle fraction has an end point not greater than 650° F.

14. The process described in claim 10 wherein said recovered hydrocracker recycle fraction has an end point not greater than 650° F.

15. The process described in claim 11 wherein said recovered hydrocracker recycle fraction has an end point not greater than 650° F.

16. The process described in claim 12 wherein said recovered hydrocracker recycle fraction has an end point not greater than 650° F.

17. The process described in claim 1 which includes the step of combining the hydrodesulfurised effluent and the hydrodewaxed effluent formed in step (d).

18. The process described in claim 9 which includes the step of combining the hydrodesulfurized effluent and the hydrodewaxed effluent formed in step (d).

* * * * *